United States Patent [19]

Juran

[11] 4,312,626

[45] Jan. 26, 1982

[54] MULTI-STAGE COMPRESSOR CONTROL SYSTEM AND METHOD

[75] Inventor: Kenneth P. Juran, Arvada, Colo.

[73] Assignee: Texaco Inc., White Plains, N.Y.

[21] Appl. No.: 18,821

[22] Filed: Mar. 8, 1979

[51] Int. Cl.[3] ..... F04B 49/00

[52] U.S. Cl. ..... 417/53; 417/216; 417/244

[58] Field of Search ..... 417/216, 2, 3, 19, 53, 417/93, 244, 254, 274, 571, 265, 266; 60/431, 445, 484

[56] References Cited

U.S. PATENT DOCUMENTS

| | | | |
|---|---|---|---|
| Re. 29,333 | 8/1977 | Pensa | 417/216 |
| 2,956,501 | 10/1960 | Norlin | 417/274 X |
| 3,216,648 | 11/1965 | Ford | 417/265 X |
| 3,244,106 | 4/1966 | Guy | 417/244 |
| 3,314,594 | 4/1967 | Rietdijk | 417/244 X |
| 3,491,538 | 1/1970 | Pearson | 417/2 X |
| 3,672,161 | 6/1972 | Krusche et al. | 60/445 X |
| 3,737,252 | 6/1973 | Pilarczyk et al. | 417/53 |
| 3,803,988 | 4/1974 | Orr | 417/571 X |

*Primary Examiner*—Philip R. Coe

*Attorney, Agent, or Firm*—Carl G. Ries; Robert A. Kulason; Ronald G. Gillespie

[57] ABSTRACT

A multi-stage fluid compressor has an input and an output line and variable volume cylinders. A plurality of actuators change the volumes of the cylinders in accordance with control signal. Sensors sense the pressure of fluid entering each stage and provide signals representative of the sensed pressures. Another sensor senses the pressure of the discharge fluid and provides a corresponding signal. A circuit connected to the actuators and to the sensors provides the control signals to the actuators in accordance with the pressure signals from the pressure sensors.

8 Claims, 2 Drawing Figures

MULTI-STAGE COMPRESSOR CONTROL SYSTEM AND METHOD

BACKGROUND OF THE INVENTION

1. Field of the Invention

The present invention relates to control systems and methods in general and, more particularly, a control system and method for a multi-stage fluid compressor.

2. Summary of the Invention

A control system for a multi-stage fluid compressor having variable volume cylinders includes a plurality of actuators which change the volumes of the cylinders in accordance with control signals. Pressure sensors sense the pressure of fluid entering each stage and provides corresponding signals. Another pressure sensor senses the pressure of the discharge fluid and provides a signal representative thereof. A network connected to the actuators and to the sensors provides the control signals to the actuators in accordance with the pressure signals from the pressure sensor.

The objects and advantages of the invention will appear more fully hereinafter from a consideration of the detailed description which follows, taken together with the accompanying drawings, wherein one embodiment of the invention is illustrated by way of example. It is to be expressly understood, however, that the drawings are for illustration purposes only, and are not to be construed as defining the limits of the invention.

DESCRIPTION OF THE INVENTION

Figure 1:
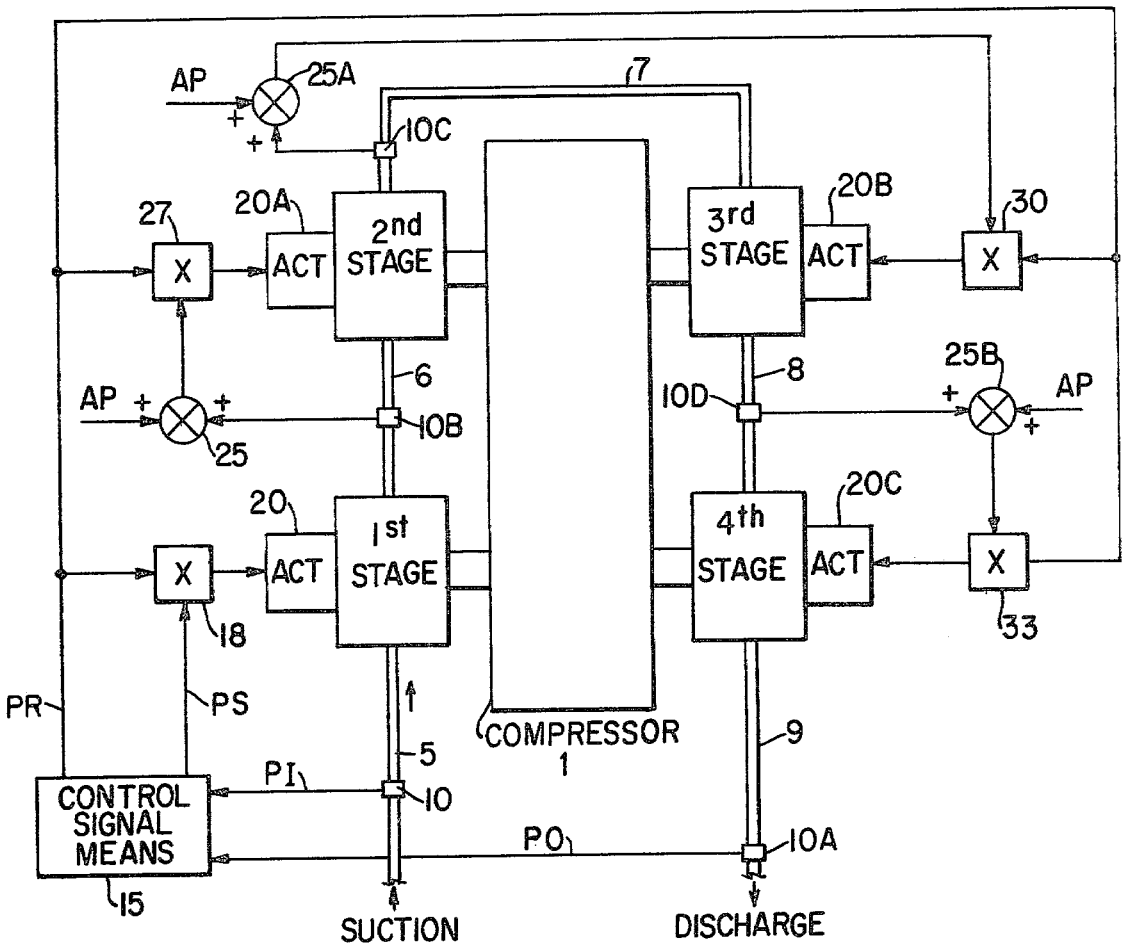
FIG. 1 shows a control system constructed in accordance with the present invention, in schematic form.

Referring now to FIG. 1, there is shown a compressor 1 having variable volume cylinders, that is a cylinder having a movable end for changing the volume of the cylinder. The cylinders are shown as first stage, second stage, third stage and fourth stage. In operation, a fluid is sucked in by way of a line 5 connected to the first stage cylinder where it is compressed and passed to the second stage cylinder by a line 6. The second stage compresses it even more and feeds it to the third stage cylinder by way of a line 7. The third stage compresses it further and provides it to the fourth stage cylinder by way of line 8. The fourth stage puts it through a final compression and discharges the fluid through a line 9.

Pressure sensors 10, 10A in lines 5 and 9 provide signals PI and PO, respectively, corresponding to the pressures in those lines, to control signal means 15. Control signal means 15, which will be explained in detail hereinafter, provides a signal PR corresponding to the pressure ratio of the discharge pressure to the suction pressure PS for a stage. Signal PS is also provided to a multiplier 18 where it is multiplied with signal PR to provide a signal to an actuator 20. Actuator 20 is connected to the movable end of the first stage cylinder for positioning that end in accordance with the signal to control the compression of the first stage.

A pressure sensor 10B in line 6 senses the pressure of the fluid entering the second stage cylinder and provides a corresponding signal to summing means 25 where it is summed with a direct current voltage AP, corresponding to the atmospheric pressure, to provide a sum signal to a multiplier 27. Multiplier 27 multiplies the sum signal with signal PR to provide a signal to another actuator 20A connected to the movable end of the second stage cylinder for positioning it in accordance with the signal from multiplier 27 thus affecting the compression of the second stage. A pressure sensor 10C in line 7 senses the pressure of the fluid entering the third stage cylinder and provides it to summing means 25A where it is summed with direct current voltage AP. Summing means 25A provides a signal to a multiplier 30 where it is multiplied with signal PR. Multiplier 30 provides a signal to an actuator 20B connected to the movable end of the third stage cylinder for positioning that end in accordance with the signal from multiplier 30 to control the compression of the third stage. Yet another pressure sensor 10D senses the pressure in line 8 corresponding to the pressure of the fluid entering the fourth stage cylinder to provide a corresponding signal to summing means 25B where it is summed with voltage AP to provide a sum signal to a multiplier 33. Multiplier 33 multiplies the sum signal with signal PR and provides a signal to an actuator 20C connected to the movable end of the fourth stage cylinder for positioning that end in accordance with the signal from the multiplier.

Figure 2:
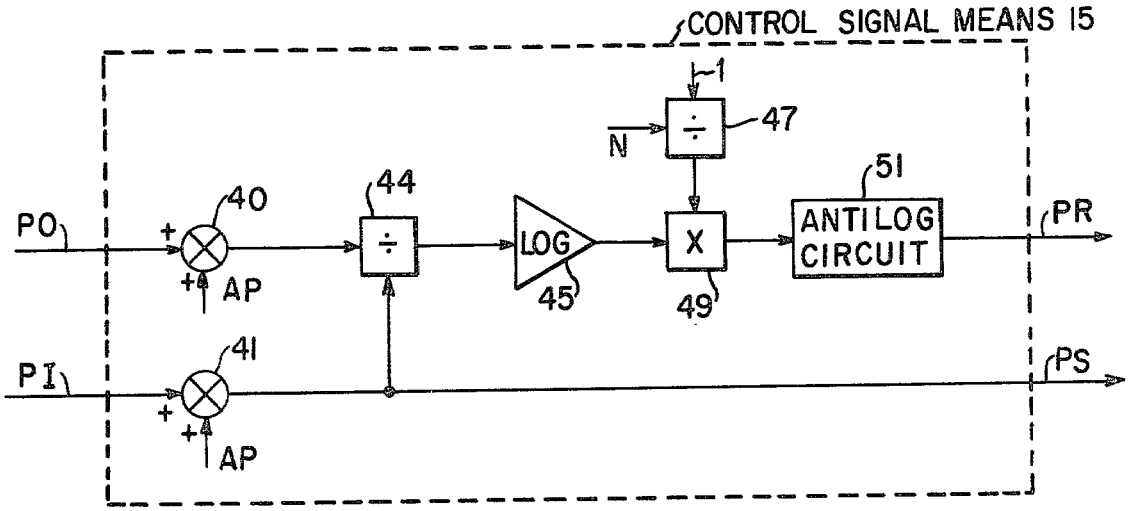
FIG. 2 is a detailed block diagram of the control signal means shown in FIG. 1.

Referring now to FIG. 2, signals PO and PI are provided to summing means 40 and 41, respectively, in control signal means 15 where they are summed with direct current voltages AP. Summing means 41 provides its sum signal as signal PS which is also applied to a divider 44. Divider 44 divides the signal from summing means 40 with signal PS to provide a signal to a logarithmic amplifier 45. A divider 47 divides a direct current voltage corresponding to a value of 1 by another direct current voltage N corresponding to the number of compression stages in the compressor to provide a signal to a multiplier 49. Multiplier 49 multiplies the signal from divider 47 with the signal from amplifier 45 to provide a signal to an antilog circuit 51. Circuit 51 provides signal PR corresponding to the pressure ratio for each stage of compression.

The present invention hereinbefore described is an automatically controlled multiple stage variable compression compressor. Although the present invention has been shown as utilizing pressure transducers generating electrical signals and electronic circuitry, it will be within the scope of the present invention to utilize equivalent pheumatic or hydraulic control techniques.

What is claimed is:

1. A control system for a multi-stage fluid compressor having an input receiving fluid and an output discharging compressed fluid and each stage having a variable volume cylinder comprising a plurality of actuating means for changing the volumes of the cylinders in accordance with control signals, means for sensing the pressure of fluid entering each stage and providing signals corresponding thereto, means for sensing the pressure of the discharge fluid and providing a corresponding signal, and means connected to all the actuating means and to all the sensing means for providing the control signals to the actuating means in accordance with the pressure signals from the sensing means.

2. A system as described in claim 1 in which the control signal means includes means connected to the sensing means for providing a signal PR corresponding to a pressure ratio for a typical stage of the compressor in accordance with the pressure signals corresponding to the fluid entering the first stage and to the discharge fluid, and a plurality of multiplying means connected to the sensing means, to all the actuating means for multiplying signal PR with the pressure signals corresponding to the fluid entering the various stages to provide corresponding control signals to the actuating means of corresponding stages.

3. A system as described in claim 2 in which the PR signal means includes a divider connected to the sensing means which divides the signal corresponding to the sensed discharge fluid pressure with the signal corresponding to the pressure of the fluid entering the first stage to provide a corresponding signal, a logarithmic amplifier connected to the divider provides a signal corresponding to the logarithm of the value of the signal from the divider, a second divider divides a voltage corresponding to a value of 1 with another voltage corresponding to the number of stages in the compressor to provide a corresponding signal, a multiplier multiplies the signal from the logarithmic amplifier with the signal from the second divider to provide a corresponding signal and an antilog circuit connected to the multiplier to provide signal PR.

4. A system as described in claim 3 in which the pressure sensing means includes a plurality of pressure sensors sensing the pressure of fluid and providing corresponding signals and a plurality of summing means on a one-for-one basis with the plurality of pressure sensors for summing the signals from the pressure sensors with a voltage corresponding to the atmospheric pressure to provide corrected pressure signals as the pressure signals.

5. A control method for a multi-stage fluid compressor having an input receiving fluid and an output discharging compressed fluid and each stage having a variable volume cylinder which comprises the steps of changing the volumes of the cylinders in accordance with control signals, sensing the pressure of fluid entering each stage, providing signals corresponding to the sensed pressures, sensing the pressure of the discharge fluid, providing a signal representative of the sensed discharge fluid pressure, and providing the control signals in accordance with all the pressure signals.

6. A method as described in claim 5 in which the control signal providing step includes providing a signal PR corresponding to a pressure ratio for a typical stage of the compressor in accordance with the pressure signals corresponding to the fluid entering the first stage and to the discharge fluid, and multiplying signal PR with the pressure signals corresponding to the fluid entering the various stages to provide corresponding control signals.

7. A method as described in claim 6 in which the PR signal step includes dividing the signal corresponding to the sensed discharge fluid pressure with the signal corresponding to the pressure of the fluid entering the first stage to provide a corresponding signal, providing a signal corresponding to the logarithm of the value of the signal from next previous step, dividing a voltage corresponding to a value of 1 with another voltage corresponding to the number of stages in the compressor to provide a corresponding signal, multiplying the logarithmic signal with the signal providing in the next previous step to provide a corresponding product signal and taking the antilog of the product signal to provide signal PR.

8. A method as described in claim 7 in which the pressure sensing step includes sensing the pressures of fluids enter inputs of the stages and providing corresponding signals, and summing each input fluid pressure signal with a voltage corresponding to the atmospheric pressure to provide a corrected pressure signal as the pressure signal.

* * * * *